United States Patent [19]

Casteel et al.

[11] Patent Number: 4,807,427

[45] Date of Patent: Feb. 28, 1989

[54] STRETCH WRAPPING ROPING APPARATUS

[75] Inventors: Larry L. Casteel, Homerville, Ohio; Robert L. Bowlin, Sr., Jeffersontown, Ky.

[73] Assignee: Liberty Industries, Inc., Girard, Ohio

[21] Appl. No.: 184,132

[22] Filed: Apr. 21, 1988

[51] Int. Cl.[4] ..... B65B 11/04

[52] U.S. Cl. ..... 53/556; 53/587; 53/441; 53/389

[58] Field of Search ..... 53/441, 556, 587, 588, 53/389

[56] References Cited

U.S. PATENT DOCUMENTS

| | | | |
|---|---|---|---|
| 4,255,918 | 3/1981 | Lancaster | 53/587 X |
| 4,336,679 | 6/1982 | Lancaster | 53/588 X |
| 4,432,185 | 2/1984 | Geisinger | 53/587 X |
| 4,563,863 | 1/1986 | Humphrey | 53/556 |
| 4,619,102 | 10/1986 | Geisinger | 53/556 X |

*Primary Examiner*—John Sipos

*Attorney, Agent, or Firm*—Harpman & Harpman

[57] ABSTRACT

An improvement for use with a stretch wrapping apparatus that applies stretchable plastic film to a basiloid container type load. The improvement comprises a roping device that gathers the plastic film into an elongated continuous band engageable on the basiloid container in the required configuration.

6 Claims, 2 Drawing Sheets

STRETCH WRAPPING ROPING APPARATUS

BACKGROUND OF THE INVENTION

1. Technical Field

This device relates to stretch wrapping devices that dispense and stretch a wide band of stretchable plastic film around a package confining the material within to a unitized package for ease of transport and handling. Basiloid containers are defined as multiple segment strips of package material positioned on the outer peripheral edges, top and bottom of the material to be shipped. In this packaging system, bands of continuous stretch plastic film are wrapped around the package by rotation of the load while the film is dispensed from a central point.

2. Description of Prior Art

Prior Art devices of this type rely on a variety of rope forming devices, see for example U.S. Pat. Nos. 4,255,918, 4,432,185 and 4,563,863.

In U.S. Pat. No. 4,255,918 a collapseable web apparatus is disclosed having a web reduction guide that engages a fixed cam rotating the guide so that the width of the wrapping material can be varied.

U.S. Pat. No. 4,432,185 discloses a pallet wrapper which has a rope forming arm thereon. At the desired point in the operation the roping arm is engaged against the web drawing same into a rope configuration.

U.S. Pat. No. 4,563,863 shows a stretch wrapping machine having a gathering apparatus that engages the web forming a rope at the end of the wrapping cycle. No specific disclosure of the roping mechanism is presented.

SUMMARY OF THE INVENTION

A stretch wrapping roping apparatus to provide a rope configuration forms a web of stretch film for use on a basiloid container. The rope forming apparatus compresses the web of stretch film into a rope configuration at the top and bottom position on a basiloid container by use of variable position guide spools.

DESCRIPTION OF THE PREFERRED EMBODIMENT

Figure 1:
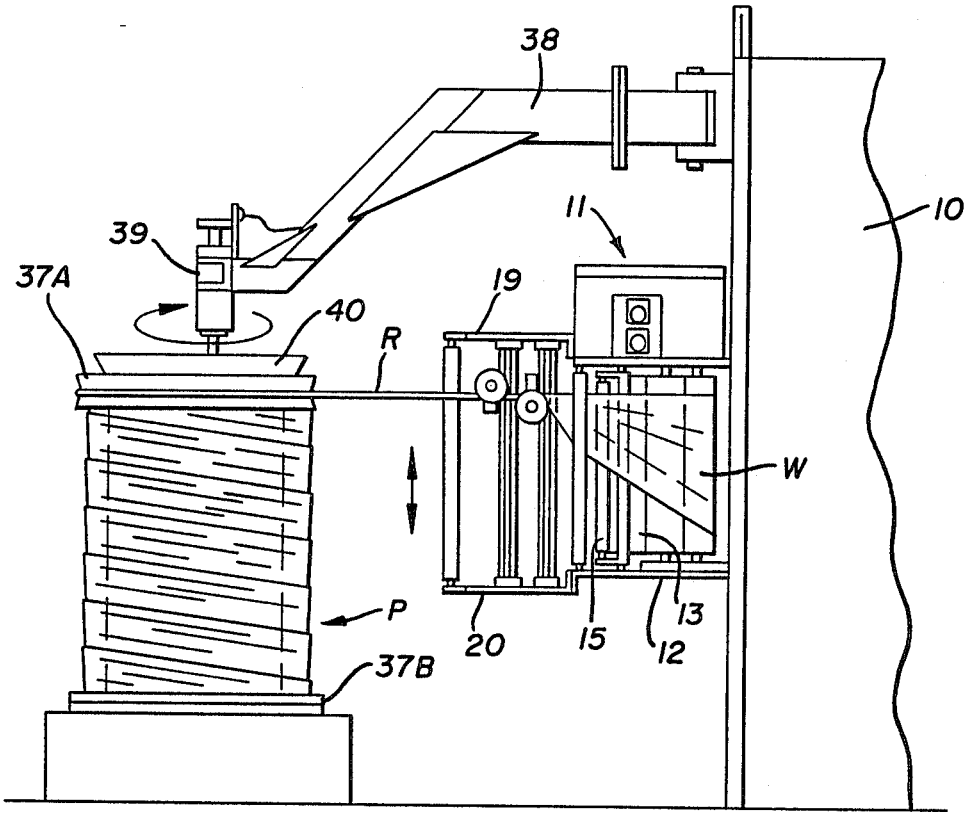
FIG. 1 is a front plan view of the invention in operation on a typical stretch wrapping device.

Referring now to FIG. 1 of the drawings, a power stretch wrapping machine is disclosed having a main support frame 10 having a stretch wrap head 11 comprising roller support frame 12 having a roll of stretch film 13 positioned thereon. The stretch film 13 can be one of a variety of those films available in this application which are well known to those skilled in the art. The roll of stretch film 13 is rotatably positioned within the roller support frame 12. A plurality of resilient rubber rollers 14 are aligned in close proximity to each other and accept the stretch film 13 as it is dispensed from the supply roll. The stretch film 13 is engaged around the rubber rollers 14 which are driven at variable speeds providing controlled and variable elongation of the stretch film 13.

Figure 2:
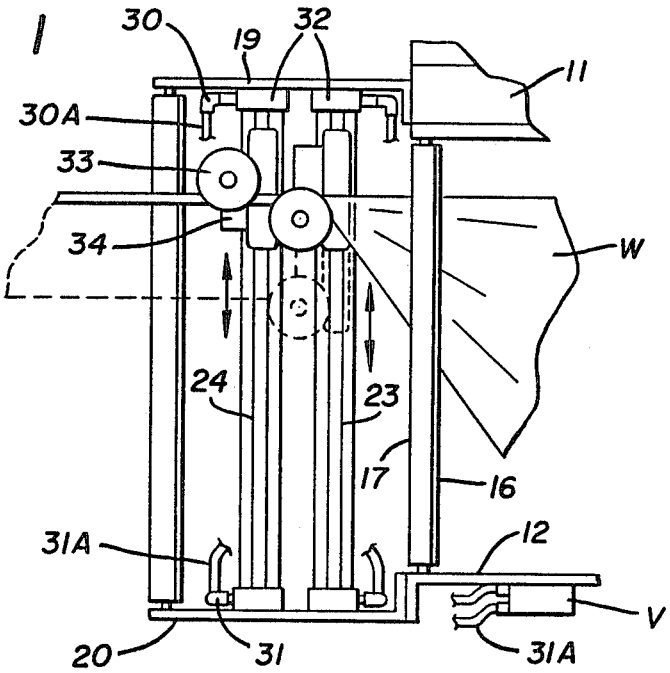
FIG. 2 is an enlarged portion of FIG. 1 of the drawings emphasizing the invention.

An intermediate guide roll 15 is positioned in spaced aligned position to said rubber rollers 14 supporting the stretch film 13 for entry between oppositely disposed dispenser rollers 16 and 17, best seen in FIG. 2 of the drawings. A drive mechanism and control circuits are inherent within the stretch wrap machine and will be will known and understood by those skilled in the perimeter of the art.

Figure 3:
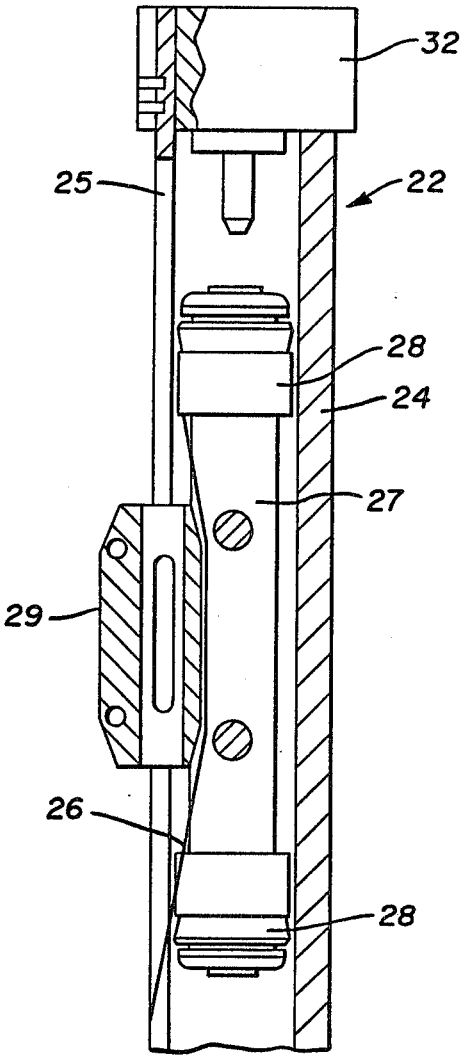
FIG. 3 is a cross-sectional view of an origa cylinder that is used in the invention.

A film rope forming apparatus 18 comprises a pair of oppositely disposed support angles 19 and 20 secured to the roller support frame 12 by fasteners. A rope guide roller 21 is rotatably secured between the support angles 19 and 20 at their respective free ends. A pair of spaced parallel control cylinders 22 and 23 are secured between said angles 19 and 20 in spaced relation to said rope guide roller 21 and said intersection of said angles 19 and 20 of said roller support frame 12. Each of the control drive cylinders 22 and 23 are comprises of an annular cylinder body member 24, best seen in FIG. 3 and 4 of the drawings. An elongated opening is formed at 25 along one side of said cylinder body member 24 with a slit flexible sealing band 26 within said opening. A piston 27 is positioned within said cylinder body member 24 and has resilient plastic seals 28 at either end thereof for sealing relation with the interior of said cylinder body 24. The piston 27 has an upstanding elongated apertured drive bracket 29 extending therefrom and through the slit at 25 in the flexible sealing band 26. The control cylinders 22 and 23 hereinbefore described are available on the open market as a origa cylinder Series 200 manufactured by Origa Corporation of 928 North Oakland Avenue, Elmhurst, Ill. 60126 and accordingly no further explanation or description of same is required.

The origa cylinders are fluid driven by a source of fluid pressure (not shown) via fluid supply inlet fittings 30 and 31 and associated lines 30L and 31L. The inlet fittings 30 and 31 are positioned within end fittings 32 in each of the cylinders 22 and 23. The independent control of the aforementioned cylinders 22 and 23 is provided by a control timing circuit via associated control valves V. The control timing circuit will be disclosed in greater detail later.

Figure 4:
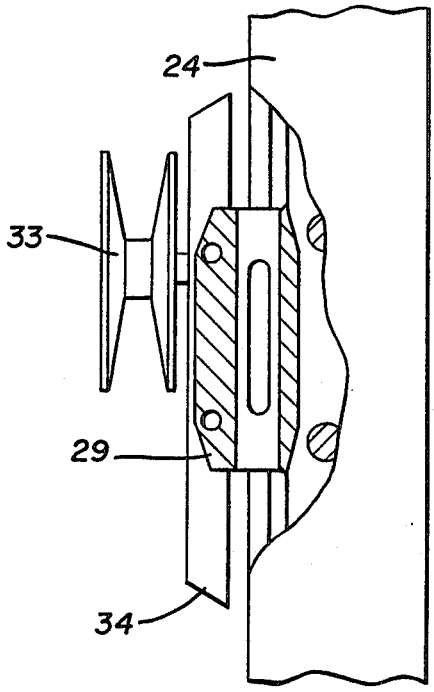
FIG. 4 is an enlarged view of a portion of the origa cylinder with other portions broken away.

Referring now to FIG. 4 of the drawings, a rope gathering spool 33 can be seen rotatably positioned on a shaft 34 secured to a transitional mounting plate 35 extending from the drive bracket 29 on the piston 27 as hereinbefore described. Each of the rope gathering spools 33 are moved independently by their respective cylinders so that varying dimensions of the stretch material can be achieved as the relative spacing between the two spools 33 is changed.

In operation, the stretch wrap machine has a turn table 36 on which a Basiloid type package P is positioned. The Basiloid type package P is characterized by its multiple elongated strips of vertically aligned corner covers and its top and bottom caps 37A and 37B. A control arm 38 extends from the stretch wrap machine above the stretch wrap head 11 extending outwardly therefrom with a vertically offset mount portion 39 on the free end thereof. A package platen is movably positioned on the mount portion 39 and is engageable against the top cap 37A of the package P, as best seen in FIG. 1 of the drawings. This arrangement is such that the package P can be rotated on its central vertical axis for stretch wrapping same.

In operation the wrap head 11 travels vertically dispensing a pre-stretched film web W onto the package P in a continuous spiral span pattern wrapping the package P securely. The width of the film web W is shown in broken lines in FIG. 2 of the drawings and in solid lines in FIG. 1 of the drawings.

As the film web W approaches the respective top and bottom caps 37A and B of the package P, a film rope R is required to provide a continuous compression band on the top and bottom caps 37A and B which has a pre-formed and located notches within to receive the rope R, as best seen in FIGS. 1 and 2 of the drawings. At this point the spools 33 come together in adjacent overlapping spacing with the film web W being reduced therebetween to the film rope R required. The control and timing circuit determines via the inputs from limit switches and other adjustable and selected inputs the rotation revolutions required, the relative position of the spools 33 via the position of the pistons 27 in the origa cylinders 22 and 23 to form the rope R with the control timing circuit directing the pre-set number of rotations of the rope R as it is applied. After wrapping is complete the film web W is cut and ready for the next package P.

The amount of stretch imparted to the film web W is determined from the type of stretch film used and speed diferential between the rollers 14 and the packaging requirements.

Figure 5:
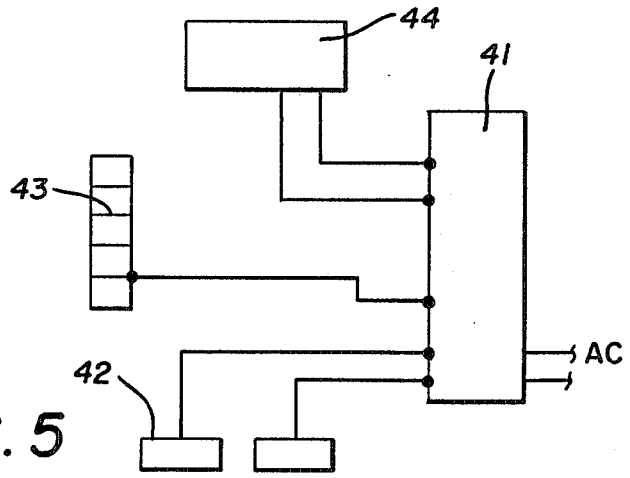
FIG. 5 is a block diagram of a central control timing and processing and inter-related flow action summary lines.

The control timing circuit is illustrated in FIG. 5 of the drawings in a flow control block diagram comprises a central control processor 41 that receives inputs from a variety of information sources including limit switches 42 and manual thumb wheels 43 that determine a pre-set rotation rope count required. A stretch wrap controller 44 is also interconnected to the central control processor 41 which controls all phases of the stretch wrapping process combined including the film rope forming apparatus 18.

Since the control features are electronic in nature changes in the package rotation rate, the film speed and stretch rate of the film utilized, rope position and duration of rotation rope can all be varied easily and automatically giving numerous variations in outside input and package types, sizes and positions, etc.

The film rope forming apparatus 18 can be used on a variety of semi-automatic or fully automatic operatorless spiral or overhead stretch wrapping machines now presently available in the industry. Since the film rope forming apparatus 18 and the stretch wrap machine on which it is used are both electronically variable the film web in the wrap mode can be delivered at a given force to load level that is different than the force to load level required in the roping mode. These changes enforced to load level must be achieved with the film under the dramatic effect of high percentages of pre-stretched film. Thus, the time for changing force levels as well as to regulate the speed of the roping apparatus 18 all have in effect when switching back and forth between full width wrap and rope forming configuration. In operation the film rope forming apparatus 18 on a fully automatic stretch wrap machine follows the following operational sequence.

1. The basiloid container is positioned on the turn table 34.

2. The package platen 40 is engaged on the package P stabilizing the load on the turn table.

3. The turn table 36 will rotate through a programmed acceleration to prevent jarring of the package P with a sudden start and gain momentum up to a pre-set wrapping speed. While the turn table 36 is rotating the film W is automatically fed to the package P at the pre-set force and the stretch wrap head 11 will begin to travel upwards at a pre-set speed allowing a pre-determined amount of overlap of the film web W while wrapping the basiloid container.

4. Once the film web W reaches the top of the basiloid container, it automatically stops the stretch wrap head 11 and begins to automatically count the number of pre-set top wraps required. The film delivery automatically switches into a rope mode by activation of the film rope forming apparatus 18 which adjusts the height to align the rope and precisely apply the ropes to the predetermined and located notches that are on the basiloid containers top cap 37A as hereinbefore described.

5. After the pre-set number of ropes are applied the system can either supply more full top wraps to the load and descend or immediately descend to the bottom height position which has been pre-determined by the operator.

6. After reaching the bottom position the film mode system switches to the roping mode automatically adjusting the rope height to align and apply the rope precisely in a predetermined located notches in the basiloid container's bottom cap 37B.

7. After the pre-set number of ropes are applied to the bottom cap 37B the machine automatically adjusts back to the film wrap mode applying a final pre-set number of wraps to the package.

8. When the wraps to the package P are complete, the turn table speed proceeds to a predetermined deceleration speed mode and stops the turn table precisely at a pre-determined aligned position.

The film web W is then cut and the package is released from the apparatus.

Thus, it will be seen that a new and novel film rope forming apparatus has been illustrated and described and it will be apparent to those skilled in the art that various changes and modification may be made therein without departing from the spirit of the invention.

I claim:

1. A film rope forming apparatus for use with a stretch wrapping machine comprises a pair of spaced vertically aligned support angles secured to said stretch wrap machine, a pair of control drive cylinders positioned between said respective support angles, a rope forming and gathering spool movably positioned on each of said drive cylinders for engaging opposite longitudinal edges of the film, guide means for supplying pre-stretch wrapping film to said rope gathering spools, secondary guide means to engage said pre-stretch wrapping film exiting said rope gathering spools, means for controlling a relative position of said rope gathering spools to one another, a package rotatably positioned on a turntable aligned for engagement of said prestretch wrapping film, means for controlling the rate of supply of said pre-stretch wrapping material and rate and count of rotation of said package on said turntable.

2. The film rope forming apparatus of claim 1 wherein said guide means for supplying pre-stretch wrapping film to said rope gathering spool comprises a pair of oppositely disposed dispenser rollers.

3. The film rope forming apparatus of claim 1 wherein said secondary guide means to engage said film comprises a single rope guide roller aligned with said rope gathering spools.

4. The film rope forming apparatus of claim 1 wherein said means for controlling the relative position of said rope gathering spools to one another comprises a source of fluid pressure interconnected to said control drive cylinders via inlet and outlet supply lines and control valves.

5. The film rope forming apparatus of claim 4 wherein said control valves are activated by a central control and timing device.

6. The film rope forming apparatus of claim 1 wherein said means for controlling the rate of supply of said pre-stretch wrapping material and the rate of count of rotation of said package on said turntable comprises multiple selective inputs, both auto and manual in a central control and timing device interconnected with said stretch wrap machine and said film rope forming apparatus.

* * * * *